United States Patent [19]

Forrest

[11] Patent Number: 5,058,677

[45] Date of Patent: Oct. 22, 1991

[54] TWO-STEP METHOD FOR HORIZONTAL GRAVEL PACKING

[75] Inventor: James K. Forrest, Lafayette, La.

[73] Assignee: Chevron Research and Technology Company, San Francisco, Calif.

[21] Appl. No.: 585,424

[22] Filed: Sep. 20, 1990

[51] Int. Cl.[5] ..... E21B 43/04

[52] U.S. Cl. ..... 166/278

[58] Field of Search ..... 166/276, 278, 50, 51

[56] References Cited

U.S. PATENT DOCUMENTS

| | | | |
|---|---|---|---|
| 2,952,318 | 9/1960 | Ritch | 166/278 |
| 3,695,355 | 10/1972 | Wood et al. | 166/278 X |
| 4,008,763 | 2/1977 | Lowe, Jr. | 166/278 X |
| 4,046,198 | 9/1977 | Gruesbeck et al. | 166/278 |
| 4,460,045 | 7/1984 | Elson et al. | 106/278 |
| 4,553,595 | 11/1985 | Huang et al. | 166/278 |
| 4,915,173 | 4/1990 | Davis | 166/278 |
| 4,969,523 | 11/1990 | Martin et al. | 166/278 |

*Primary Examiner*—George A. Suchfield

*Attorney, Agent, or Firm*—Edward J. Keeling; Ernest A. Schaal

[57] ABSTRACT

A method is disclosed for placing gravel within an annulus formed in a non-vertical borehole by the placement of a screen within the borehole. First, a slurry of gravel, polymer, and oil field brines is injected into the annulus to control fluid leakoff, pack the perforations, and pack from 50% to 75% of the screen-borehole annulus. Then a slurry of gravel and water is injected into the annulus until the annulus is completely packed.

3 Claims, 1 Drawing Sheet

TWO-STEP METHOD FOR HORIZONTAL GRAVEL PACKING

The present invention relates to a method for placing gravel within an annulus in a non-vertical borehole.

BACKGROUND OF THE INVENTION

Few horizontal wells have been completed in unconsolidated formations. Most operators have completed their horizontal wells in consolidated formations using slotted liners to provide borehole stability and a limited amount of sand control. In a recent application in a friable sandstone, pre-packed screens were successfully used in open-hole horizontal well completions. Gravel packing, the industry's preferred sand control method for vertical and deviated wells, has rarely been applied in horizontal wells.

Previous work showed that low-viscosity carrier fluids such as water could completely pack short horizontal model wells, but there are potential drawbacks for field applications. They may require the use of low gravel concentrations, longer placement times, and larger carrier fluid volumes. In permeable formations, excessive fluid loss can occur, damaging the formation. Gravel settling in the tubing during pumping is another concern.

SUMMARY OF THE INVENTION

The present invention provides a two-step process for placing gravel within an annulus formed in a non-vertical borehole by the placement of a screen within the borehole. In this invention, a slurry of gravel and a medium viscosity carrier fluid is injected into the annulus to control fluid leakoff, pack the perforations, and pack from 50% to 75% of the screen-borehole annulus. Then, a slurry of gravel and a low viscosity carrier fluid is injected into the annulus until the annulus is completely packed. The medium viscosity carrier fluid can comprise oil field brines and polymer. The low viscosity carrier fluid can comprise water.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
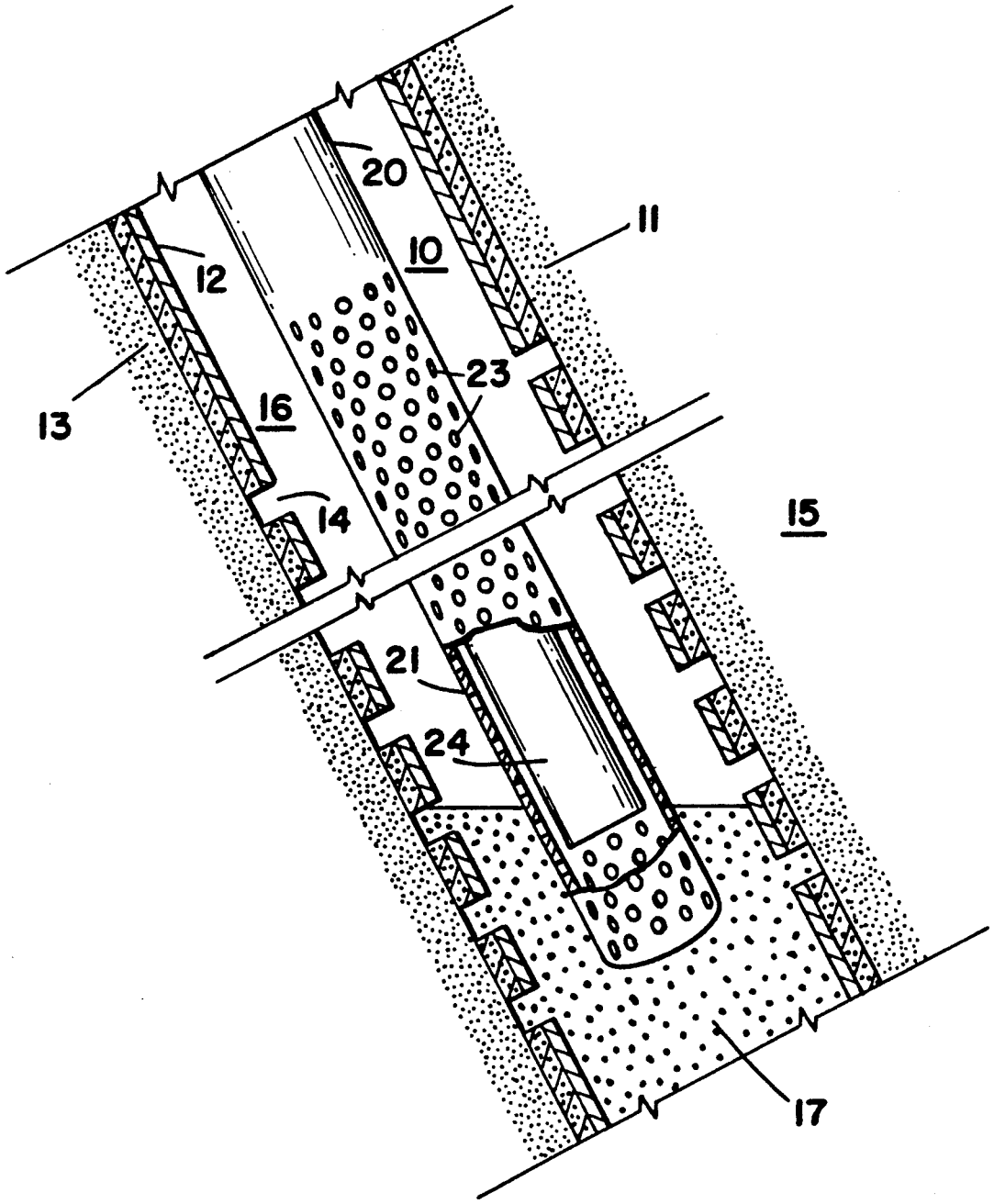
FIG. 1 is a schematic of a liner having a wide diameter stinger inserted therein.

In its broadest aspect, the present invention involves a two-step injection method for placing gravel within an annulus within a non-vertical borehole.

The annulus is formed in a non-vertical borehole by placing a screen within the borehole. Such an annulus is disclosed in Gruesbeck et al.'s U.S. Pat. No. 4,046,198, entitled "Method and Apparatus for Gravel Packing Wells," which is hereby incorporated by reference for all purposes.

With reference to FIG. 1, an inclined wellbore 10 penetrates a subterranean producing formation 11. A well casing 12 which extends through the well and is held in place by cement 13, is provided with perforations 14 in the producing zone 15. A lower portion of wellbore 10 may be enlarged in the perforated interval to provide a larger borehole in the producing zone 15 to be gravel packed.

Perforated liner 20 is placed in the wellbore 10 opposite producing zone 15. An annular space 16 defined by the liner 20 and casing 12 is the area which is to be packed with gravel. For purposes of the present discussion, the terms "liner" or "perforated liner" as used herein refer to a wide range of tubular subsurface devices used in wells. Such devices are referred to in the art as "preperforated liners," "vertically slotted liners," "horizontally slotted liners," "screens," "prepacked screens," "wire wrapped screens" and the like. The term "gravel", as used herein, refers to any granular or aggregate material used for filtering purposes in subsurface wells.

The liner 20 is lowered into the wellbore 10 on the well tubing string (not shown) which normally includes a crossover tool (not shown). Gravel and a carrier liquid, normally water, are mixed to form a gravel suspension which is then pumped through the tubing, crossing over to the outside of liner 20. The gravel 17 is deposited within the annular space 16. Two types of carrier liquid enter liner 20. They enter through perforations 23 and flow down the inside of liner 20 and into the lower end of stinger 24, located within the liner. From there, they flow to the surface. Sufficient gravel is deposited in this manner until the entire liner 20 is packed. Produced fluids can then flow freely from the producing zone 15 through the gravel 17 into liner 20.

The first type of carrier liquid injected is a slurry of gravel and a medium viscosity carrier fluid into the annulus to pack from 50% to 751% of the screen-borehole annulus. This first type of carrier liquid controls fluid leakoff and packs the perforations.

Preferably, the medium viscosity carrier fluid comprises oil field brines and polymer. Examples of polymers that would work include hydroxyethyl cellulose (HEC) and xanthan (XC). Gravel pack slurry can be prepared by mixing gravel at varying concentrations of 2 to 15 ppg (pounds per gallon of carrier fluid) with a portion of the viscous carrier. Before pumping, a chemical breaker can be added to the viscosified carrier fluids. One such slurry might comprise HEC carrier fluid, HEC concentrations of 50 to 80 lb/kgal, and 4 ppg of 20–40 U.S. Mesh Ottawa gravel.

The second type of carrier liquid injected is a slurry of gravel and a low viscosity carrier fluid (such as water) until the annulus is completely packed.

DESCRIPTION OF THE GRAVEL PACK PROCESS FOR VISCOSIFIED CARRIER

According to one description of the gravel pack process, a gravel dune is formed, the dune propagates downward until it reaches the bottom of the wellbore, then packing continues above the dune from the bottom of the well upward. However, this description applies only to Newtonian carrier fluids such as water, pumped under turbulent flow conditions. The placement process is different for non-Newtonian fluids such as HEC and XC carrier fluids.

In the first part of the placement process with a viscosified carrier fluid, a dune is formed at some equilibrium bank height. That equilibrium bank height has been defined as a dynamic equilibrium between deposition and suspension of gravel particles. The velocity of the carrier fluid in the screen-casing annulus at equilibrium conditions is the equilibrium velocity. As long as this velocity is maintained, the dune or gravel bank does not grow upward, allowing this carrier fluid to transport gravel across the dune. This first part of the process is the same for Newtonian and non-Newtonian fluids, but the process begins to differ in the next stage.

During the second stage, the dune propagates toward the end of the well (downward). While the dune is propagating downward, the resistance to flow in the screen-casing annulus rises continuously (non-linearly). As this resistance increases, more carrier fluid flows into the tailpipe-screen annulus, increasing the velocity of this fluid. Because HEC and XC carrier fluids are shear-thinning, the resistance to flow in the tailpipe-screen annulus does not increase proportionately to the increase in flow.

As more fluid is diverted into the tailpipe-screen annulus, fluid velocity in the screen-casing annulus decreases from its original equilibrium velocity. This decrease in velocity causes additional gravel deposition, allowing the bank height to grow upward (i.e. there is not true equilibrium).

At a late stage in the process, increased resistance to flow in the screen-casing annulus causes the carrier fluid velocity in that annulus to drop below a minimum value needed to transport gravel. A sandout immediately follows this stage. After sandout, after-pack settling reduced the packed wellbore volume by a few percent. After-pack settling is unavoidable because the gravel is never fully dehydrated in this placement process.

A two-stage packing technique using a combination of HEC and water slurries improves gravel placement by overcoming the problems associated with HEC slurries at the later stages.

While the present invention has been described with reference to specific embodiments, this application is intended to cover those various changes and substitutions that may be made by those skilled in the art without departing from the spirit and scope of the appended claims.

What is claimed is:

1. A method for placing gravel within an annulus formed in a non-vertical borehole by the placement of a screen within the borehole comprising:

(a) injecting into said annulus a slurry of gravel and a medium viscosity carrier fluid to pack from 50% to 75% of the screen-borehole annulus; and (b) injecting into said annulus a slurry of gravel and a low viscosity carrier fluid until the annulus is completely packed.

2. A method according to claim 1 wherein said medium viscosity carrier fluid comprises oil field brines and polymer.

3. A method according to claim 1 wherein said low viscosity carrier fluid comprises water.

* * * * *